US006422949B1

(12) United States Patent
Byrne et al.

(10) Patent No.: US 6,422,949 B1
(45) Date of Patent: Jul. 23, 2002

(54) GOLF BALL AND PUTTER ALIGNMENT COMBINATION

(75) Inventors: Wayne H. Byrne, Murrieta; Ronald K. Hettinger, Oceanside, both of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/799,929

(22) Filed: Mar. 5, 2001

(51) Int. Cl.[7] ..... A63B 69/36; A63B 37/00

(52) U.S. Cl. ..... 473/200; 473/251; 473/280; 473/351

(58) Field of Search ..... 473/200, 268, 473/266, 378, 257, 218, 280, 351, 213, 282, 251; 40/327; 434/252

(56) References Cited

U.S. PATENT DOCUMENTS

| | | | | |
|---|---|---|---|---|
| 676,506 | A | * | 6/1901 | Knight |
| 1,842,844 | A | * | 1/1932 | O'Brien |
| 2,709,595 | A | * | 5/1955 | De Vries |
| 3,753,565 | A | * | 8/1973 | Baker |
| 3,880,430 | A | * | 4/1975 | McCabe |
| D246,329 | S | * | 11/1977 | Little |
| 4,209,172 | A | * | 6/1980 | Yamamoto |
| 4,258,921 | A | * | 3/1981 | Worst |
| 4,284,276 | A | * | 8/1981 | Worst |
| 4,441,716 | A | * | 4/1984 | Chen |
| 4,603,862 | A | * | 8/1986 | Chen |
| 4,706,958 | A | | 11/1987 | Inoue |
| 4,928,971 | A | | 5/1990 | Soles, Jr. |
| 5,067,719 | A | * | 11/1991 | Mook |
| 5,174,573 | A | | 12/1992 | Desbiolles et al. |
| 5,542,680 | A | * | 8/1996 | Proudfit |
| 5,564,707 | A | * | 10/1996 | Dinh |
| 5,564,990 | A | | 10/1996 | Weeks |
| 5,713,799 | A | * | 2/1998 | Balmat |
| 6,004,223 | A | * | 12/1999 | Newcomb |
| 6,062,986 | A | * | 5/2000 | Kaise |

* cited by examiner

*Primary Examiner*—Sebastiano Passaniti
(74) *Attorney, Agent, or Firm*—Michael A. Catania

(57) ABSTRACT

A golf ball and putter alignment combination is disclosed herein. The golf ball has a surface with alignment indicia which includes a longitudinal segment and a latitudinal segment. Preferably, the longitudinal segment extends along a pole of the golf ball and has a length ranging from 1.00 inch to 1.5 inches. The putter has an alignment indicia that is aligned with the alignment indicia of the golf ball to allow for a more accurate putt.

7 Claims, 3 Drawing Sheets

GOLF BALL AND PUTTER ALIGNMENT COMBINATION

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a alignment inventions for a golf ball and putter. More specifically, the present invention relates to a golf ball having an alignment indicia and a putter having a corresponding alignment indicia.

2. Description of the Related Art

Putting is a very difficult, if not the most difficult part of the game of golf. When attempting to putt a golf ball into a hole on a green, the golfer attempts to align the direction of the golf ball with the hole, and to putt toward the hole. However, the golfer is above the golf ball and his or her visual perception is skewed allowing for misperception of the exact direction he or she should putt the golf ball.

The golf industry has provided alignment devices in the past to assist golfers with putting, and aligning a golf ball with the hole. One example is set forth in U.S. Pat. No. 4,928,971 for an Alignment System that discloses markings on a putter which include a first line, a second line perpendicular to the first line, and a conical depression.

Another example is the SEEMORE® putter which is disclosed in U.S. Pat. No. 5,64,990 and at www.seemore-.com. The alignment markings of the SEEMORE® putter include two parallel lines that border a circular marking which is screened from view if the golfer is properly aligned.

Yet another example is set in U.S. Pat. No. 5,174,573 for a Putter Having A Head With Ball-Centering Indicia which discloses a curvilinear reference on the crown of the putter. Another example is Inoue, U.S. Pat. No. 4,706,958. Inoue discloses a golf ball that is capable of being stroked in the direction of its center of gravity by providing markings on the golf ball.

However, the prior art fails to disclose a golf ball and putter combination that allows for more accurate putting.

BRIEF SUMMARY OF THE INVENTION

The present invention provides a solution to more accurate putting without departing from the Rules of Golf The present invention marks a golf ball with alignment indicia to allow a golfer to properly place the golf in direction toward a hole. The golf ball also has marking thereon for aligning with a face of a putter for proper putting.

One aspect of the present invention is a golf ball and putter combination for proper alignment during a putt. The golf ball has a surface with alignment indicia. The alignment indicia includes a first line extending along at least an eighth of the circumference of the golf ball, and a second line perpendicular to the first line and extending at least an eighth of the circumference of the golf ball. The first line is positioned at a mid-section of the second line. The putter has a body with a face, a crown, a sole, a toe end, a heel end, a flange extending rearward with a top surface and bottom surface, and a hosel disposed on the heel end. The putter also has a shaft attached to the body through the hosel. The crown has a first alignment line extending parallel with the face and a second alignment line disposed on the top surface of the flange. The second alignment line perpendicular to the first alignment line. The alignment of the first alignment line of the putter and the second line of the golf ball will result in a more accurate putt.

Another aspect of the present invention is a golf ball with alignment indicia to be utilized with a putter. The golf ball has a surface with alignment indicia. The alignment indicia includes a longitudinal segment extending along a pole of the golf ball and has a length ranging from 1.00 inch to 1.5 inches. The alignment indicia also includes a latitudinal segment that is perpendicular to the longitudinal segment and has a length ranging from 0.50 inch to 2.0 inches. The longitudinal segment intersects a mid-point of the latitudinal segment. The putter has a body with a face, a crown, a sole, a toe end, a heel end, and a hosel disposed on the heel end. The putter also has a shaft attached to the body through the hosel. The alignment of the face of the putter and the latitudinal segment of the golf ball will result in a more accurate putt.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
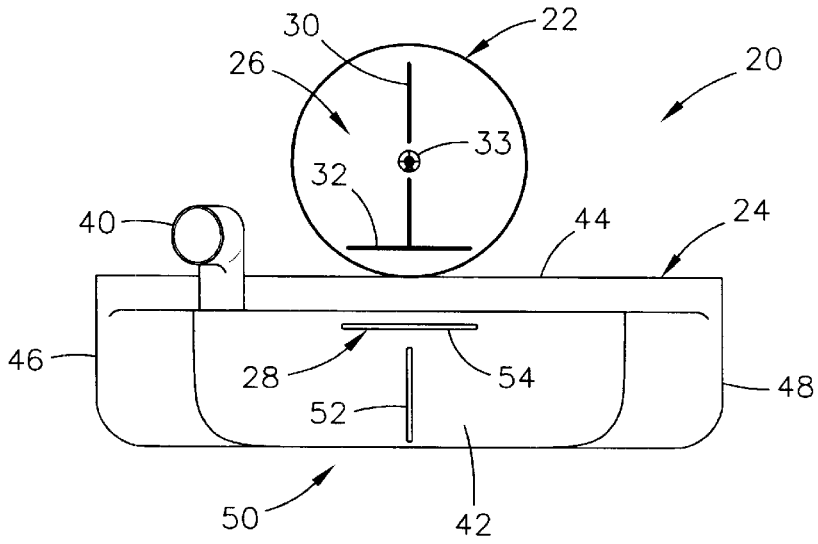
FIG. 1 is a top plan view of the combination putter and golf ball of the present invention.

As shown in FIG. 1, the combination 20 of the present invention is generally designated 20. The combination 20 includes a golf ball 22 and a putter 24, which are marked with alignment indicia 26 and 28 to provide a typical golfer with a means to more accurately putt the golf ball 22 into a hole. The golf ball 22 may be a typical golf ball, preferably having a diameter of approximately 1.68 inches or greater since USGA Rules dictate such a diameter for the golf ball. However, those skilled in the pertinent art will recognize that golf balls with smaller diameter may be used without departing from the scope and spirit of the present invention.

The golf ball 22 preferably has a white surface, however, other colors may be used for the surface of the golf ball 22. The golf ball 22 is preferably a three-piece solid golf ball, however, two-piece, four-piece, wound, hollow core and liquid-filled core golf balls may also be used for practicing the present invention. The cover of the golf ball 22 may be composed of an ionomer, balata (transpolyisoprene), polyurethane or similar polymer material. The cover is typically coated with a base coat (typically pigmented) and/or a clear top coat.

The alignment indicia 26 is printed on the surface of the golf ball 22. The alignment indicia 26 is preferably printed on a base coat with a top coat applied over the alignment indicia 26. However, in an alternative embodiment the alignment indicia 26 is printed on the top coat of the golf ball 22.

The alignment indicia 26 is composed of a longitudinal segment 30 and a latitudinal segment 32, and optionally a pole indicia 34. The longitudinal segment 30 is typically a straight line across the pole 33 of the golf ball 22. The pole indicia 34 is printed on the pole 33 to indicate the top of the golf ball 22. The golf ball 22 has a top pole 33 and a bottom pole 33*a*, not shown, which are each an equal distance from an equator 35 of the golf ball 22. The equator 35 typically lies on a seam line of the golf ball 22 which is indicative of the seam buffing of molding remnants that remain on the golf ball 22 after de-molding during processing of the golf ball 22.

Figure 12:
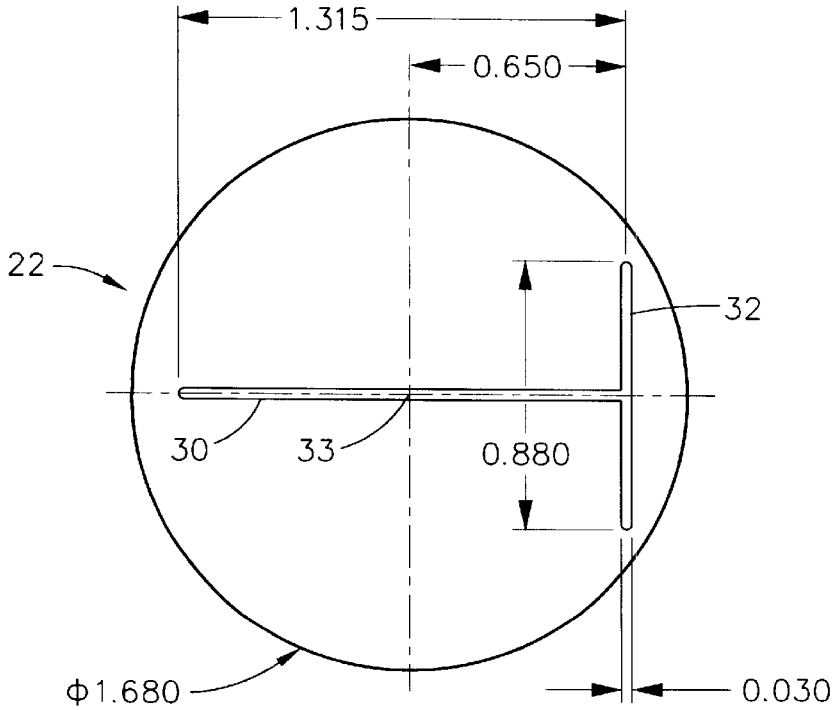
FIG. 12 is an enlarged schematic view of a golf ball of the present invention.

As shown in FIG. 12, the longitudinal segment 30 preferably extends from 1.00 inch to 1.5 inches across the pole 33 of the golf ball 22, with the pole 33 preferably dividing the longitudinal segment 30 into two equal portions. A preferred length of the longitudinal segment 30 is 1.35 inches, with the midpoint of the longitudinal segment 30 lying on the top pole 33 of the golf ball. The longitudinal segment 30 provides the golfer with a visual straight line to align the golf ball 22 with the hole on the green. Also, the pole indicia 34 allows the golf ball 22 to be properly placed with the very top of the golf ball 22, the top pole 33, perpendicular to the ground.

The latitudinal segment 32 preferably ranges from 0.5 inch to 2.0 inches in length. Both the latitudinal segment and the longitudinal segment have a width the ranges from 0.075 inch to 0.140 inch. Visually, the latitudinal segment 32 is perpendicular or substantially perpendicular to the longitudinal segment 30. Visually, the latitudinal segment 32 is parallel or substantially parallel to the alignment indicia 28 of the putter 24. The latitudinal segment 32 provides the golfer with a visual straight line to strike the golf ball 22 with the putter 24 thereby hopefully providing a straighter putt.

Figure 13:
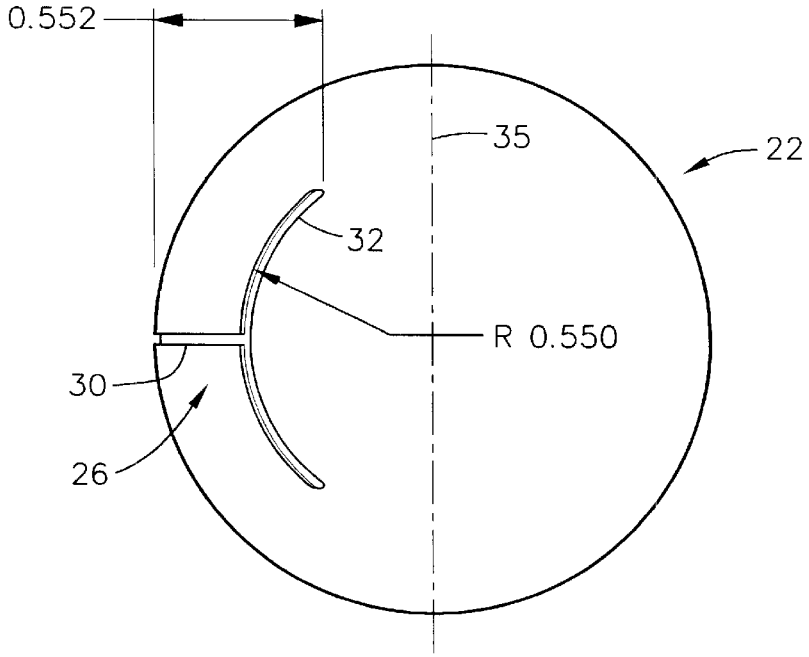
FIG. 13 is an enlarged schematic view of a golf ball of the present invention.

However, as shown in FIG. 13, the latitudinal segment 32 is curved along the spherical surface of the golf ball 22 when viewed from a plan view of the equator 35. The radius of curvature, "R", of the latitudinal segment 32 preferably ranges from 0.450 inch to 0.650 inch, with a preferred radius of curvature of 0.550 inch.

Figure 2:
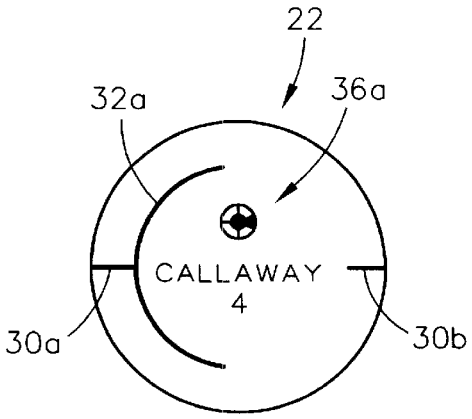
FIG. 2 is an isolated front view of a preferred embodiment of the golf ball of the present invention.
Figure 3:
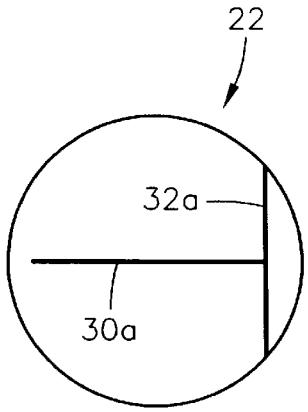
FIG. 3 is an isolated side view of the golf ball of FIG. 2.
Figure 4:
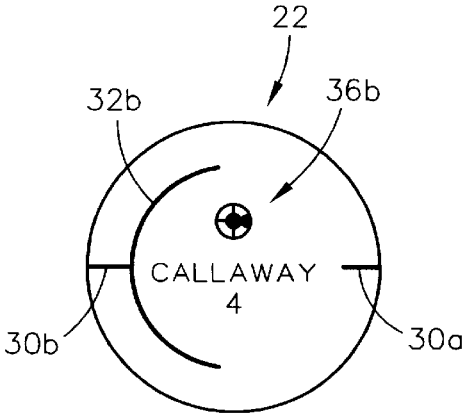
FIG. 4 is an isolated rear view of the golf ball of FIG. 2.

The curvature of the golf ball 22 allows for variation in the alignment indicia 26, especially the latitudinal segment 32. One embodiment of the golf ball 22 of the present invention is shown in FIGS. 2–4. FIG. 2 is a front view of a golf ball 22, FIG. 3 is a view of the golf ball 22 rotated ninety degrees, and FIG. 4 is a view of the golf ball rotated an additional ninety degrees. In this embodiment, there is a first longitudinal segment 30*a* intersected by a first latitudinal segment 32*a*. The golf ball 22 also has a first logo indicia 36*a* which includes typical markings that. are printed on a golf ball 22 to designate origin of the golf ball 22. The golf ball 22 also has a second longitudinal segment 30*b* intersected by a second latitudinal segment 32*b*, along with a second logo indicia 36*b*. The first and second latitudinal segments 32*a–b* are semi-circles with a mid-point respectively intersecting first and second longitudinal segments 30*a–b*. During putting, a golfer would position the golf ball 22 of this embodiment as shown in FIG. 3 when viewed from directly above. Thus, the curved latitudinal segment 32*a* appears to be a straight line. The latitudinal segment 32 is positioned so as to be as close to a face 39 of a putter 24 while still being viewed from above as a straight line.

Figure 5:
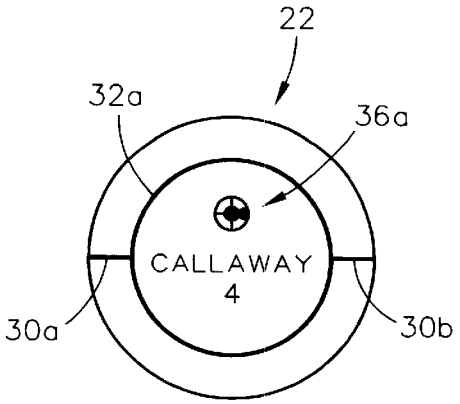
FIG. 5 is an isolated front view of an alternative embodiment of the golf ball of the present invention.
Figure 6:
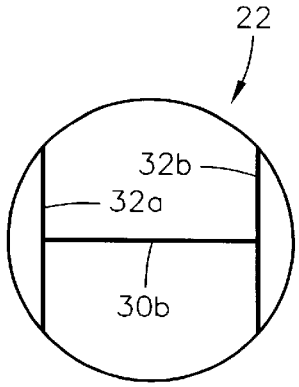
FIG. 6 is an isolated side view of the golf ball of FIG. 5.
Figure 7:
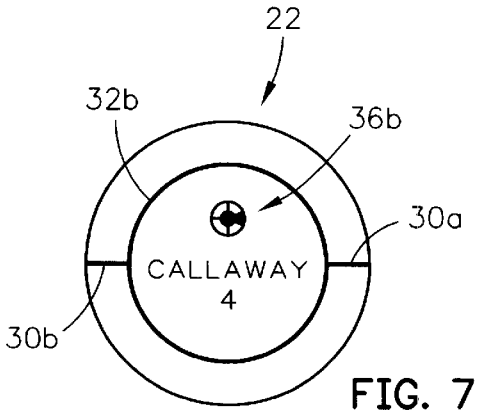
FIG. 7 is an isolated rear view of the golf ball of FIG. 5.
Figure 8:
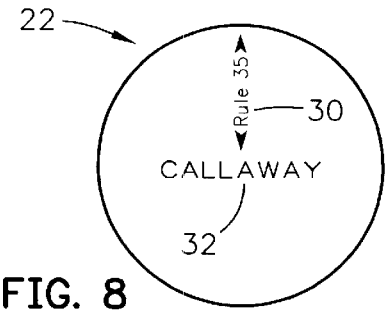
FIG. 8 is an isolated top view of an alternative embodiment of the golf ball of the present invention.
Figure 9:
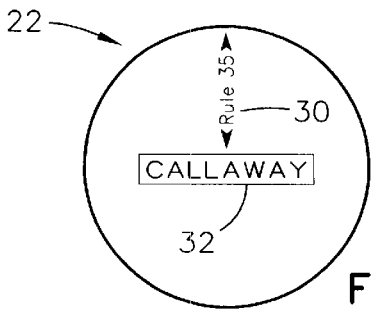
FIG. 9 is an isolated top view of an alternative embodiment of the golf ball of the present invention.
Figure 10:
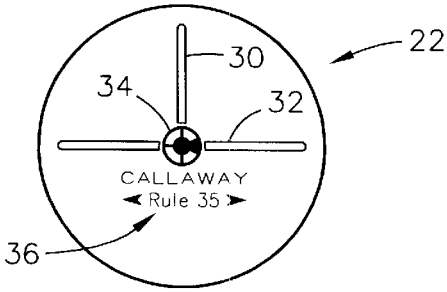
FIG. 10 is an isolated top view of an alternative embodiment of the golf ball of the present invention.
Figure 11:
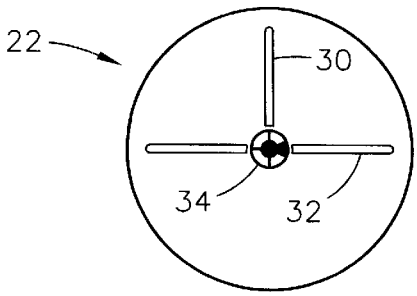
FIG. 11 is an isolated top view of an alternative embodiment of the golf ball of the present invention.

Another embodiment of the golf ball 22 of the present invention is shown in FIGS. 5–7. FIG. 5 is a front view of a golf ball 22, FIG. 6 is a view of the golf ball 22 rotated ninety degrees, and FIG. 7 is a view of the golf ball rotated an additional ninety degrees. In this embodiment, the first longitudinal segment 30*a* intersects the first latitudinal segment 32*a* and the second latitudinal segment 32*b*. The golf ball 22 also has a first logo indicia 36*a* which is encircled by the first latitudinal segment 32*a*. The golf ball 22 also has a second longitudinal segment 30*b* which intersects the first latitudinal segment 32*a* and the second latitudinal segment 32*b*. The second latitudinal segment 32*b* encircles a second logo indicia 36*b*. The first and second latitudinal segments 32*a–b* are circles that intersect the first and second longitudinal segments 30*a–b* at points that are one-hundred eighty degrees from each other. During putting, a golfer would position the golf ball 22 of this embodiment as shown in FIG. 6 when viewed from directly above. Thus, the circular latitudinal segment 32*a* appears to be a straight line.

Other embodiments of the golf ball 22 of the present invention are illustrated in FIGS. 8–10 11. The golf balls 22 of FIGS. 8 and 9 utilize logo indicia for the longitudinal segment 30 and the latitudinal segment 32. In such embodiments, the logo indicia is composed of letters and or symbols positioned accordingly to create the longitudinal segment 30 and the latitudinal segment 32. The golf balls 22 of FIGS. 10 and 11 utilize a pole indicia 34 with lines for the longitudinal segment 30 and latitudinal segment 32. Those skilled in the relevant art will recognize numerous other variations for the alignment indicia 26 which may be utilized without departing from the scope and spirit of the present invention.

The application of the alignment indicia 26 is preferably accomplished through use of a pad-printing system that utilizes an ultraviolet light curable ink. However, those skilled in the pertinent art will recognize that other printing systems may be utilized to apply the alignment indicia 26 without departing from the scope and spirit of the present invention.

Returning to FIG. 1, the putter 24 is typically composed of a face 39, a hosel 40, a crown 42, a heel end 46, a toe end 48 and a sole 50. The putter may be a blade type putter or an insert type putter such as an ODYSSEY® putter from Callaway Golf Company of Carlsbad, Calif. The alignment indicia 28 is printed, embossed, painted or in some other manner applied to the crown. In a preferred embodiment, the alignment indicia 28 includes a longitudinal segment 52 and a latitudinal segment 54. An alternative embodiment of the alignment indicia 28 only includes the latitudinal segment 54. The latitudinal segment generally ranges from 0.75 inch to 2.0 inches in length, and is disposed on the crown 42 nearest the face 39 of the putter 24. The optional longitudinal segment 52 is generally perpendicular to the latitudinal segment 54, and is applied on the crown 42 on substantially the mid-point of the putter 24 between the heel end 46 and the toe end 48. The length of the longitudinal segment 52 ranges from 0.25 inch to 2.00 inches depending on the width of the crown 42 of the putter 24.

The placement of the putter alignment indicia 28 allows a golfer to align the putter 24 with the properly aligned golf ball 22 to putt in a manner that should result in more accurate putts. The golfer need only align the putter alignment indicia 28 with the golf ball alignment indicia 26 in order to ensure a straight putt without visual misinterpretation of the putting of the golf ball 22 toward a hole in a green.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf ball and putter combination comprising:

the golf ball having a surface with a top and bottom pole, the poles being equal distance from the equator;

the top pole having an indicia such that when properly aligned, the indicia is perpendicular with the ground;

the golf ball also having a first alignment indicia comprising a first line, the first line bisecting the top pole indicia such that the line is divided into equal portions on opposite sides of the pole indicia and extends along at least an eighth of the circumference of the golf ball;

and a second alignment indicia comprising a second line perpendicular to the first line and extending at least an eighth of the circumference of the golf ball, the second line having a radius of curvature of 0.450 inch to 0.550 inch;

the first line positioned at a mid-section of the second line;

a putter having a body with a face, a crown, a sole, a toe end, a heel end, a flange extending rearward with a top surface and bottom surface, and a hosel disposed on the heel end, the putter also having a shaft attached to the body through the hosel, wherein the crown has an alignment line extending parallel with the face;

whereby alignment of the first alignment line with the cup; alignment of the pole indicia in proper position perpendicular to the ground; and alignment of the alignment line of the putter with the second line of the golf ball will result in a more accurate putt.

2. The combination according to claim 1 wherein the first line of the alignment indicia of the golf ball has a length ranging from 1.00 inch to 1.5 inches.

3. The combination according to claim 1 wherein the second line of the alignment indicia of the golf ball has a length ranging 0.5 inch to 2.0 inches.

4. The combination according to claim 1 wherein the first line and the second line of the alignment indicia of the golf ball each have a width that ranges from 0.075 inch to 0.140 inch.

5. A golf ball and putter combination comprising:

the golf ball having a surface wit a top and bottom pole, the poles being equal distance from the equator;

the top pole having an indicia such that when properly aligned, the indicia is perpendicular with the ground;

the golf ball also having alignment indicia, the alignment indicia comprising a longitudinal segment extending along a pole of the golf ball bisecting the top pole indicia and having a length ranging from 1.00 inch to 1.5 inches, and a latitudinal segment perpendicular to the longitudinal segment and having a length ranging from 0.50 inch to 2.0 inches, the longitudinal segment intersecting a mid-point of the latitudinal segment;

a putter having a body with a face, a crown, a sole, a toe end, a heel end, and a hosel dispose on the heel end, the putter also having a shaft attached to the body through the hosel;

whereby alignment of the top pole indicia perpendicular to the ground and alignment of the face of the putter and the latitudinal segment of the golf ball will result in a more accurate putt.

6. The combination according to claim 5, wherein the alignment indicia of the golf ball is composed of a UV curable ink.

7. The combination according to claim 5 wherein each of the longitudinal segment and the latitudinal segment of the alignment indicia of the golf ball is a logo indicia composed of letters or symbols.

* * * * *